US005549157A

United States Patent [19]

Johnson et al.

[11] Patent Number: 5,549,157

[45] Date of Patent: Aug. 27, 1996

[54] ELECTRONIC COUNTER WITH PUMP-MOUNTED SENSOR FOR CYCLE INDICATION

[75] Inventors: Richard D. Johnson, Pinckney; Robert M. Bultman, Ann Arbor; Kevin L. Newcomer, Monroe, all of Mich.

[73] Assignee: QED Enviromental Systems, Inc., Ann Arbor, Mich.

[21] Appl. No.: 328,231

[22] Filed: Oct. 24, 1994

Related U.S. Application Data

[63] Continuation-in-part of Ser. No. 38,835, Mar. 29, 1993, Pat. No. 5,358,037.

[51] Int. Cl.[6] ..... E21B 43/00; F04B 49/00

[52] U.S. Cl. ..... 166/105; 166/107; 417/12; 417/40

[58] Field of Search ..... 166/53, 105, 107, 166/54; 417/12, 36, 40, 43, 44.1

[56] References Cited

U.S. PATENT DOCUMENTS

| | | | |
|---|---|---|---|
| 1,439,591 | 12/1922 | Welden . | |
| 2,141,261 | 12/1938 | Clark . | |
| 2,606,500 | 8/1952 | Schmidt . | |
| 3,007,416 | 11/1961 | Childs . | |
| 3,039,309 | 6/1962 | Vesper et al. . | |
| 3,048,121 | 8/1962 | Sheesley . | |
| 3,074,351 | 1/1963 | Foster . | |
| 3,148,624 | 9/1964 | Baldwin . | |
| 3,154,021 | 10/1964 | Vick, Jr. . | |
| 3,173,372 | 3/1965 | Baldwin . | |
| 3,175,498 | 3/1965 | Rohrer . | |
| 3,194,170 | 7/1965 | Ulbing . | |
| 3,298,320 | 1/1967 | Latham, Jr. . | |
| 3,647,319 | 3/1972 | McLean et al. . | |
| 3,677,667 | 7/1972 | Morrison . | |
| 3,724,973 | 4/1973 | Shill . | |
| 3,816,032 | 6/1974 | Flynn et al. . | |
| 3,918,843 | 11/1975 | Douglas et al. | 417/12 |
| 3,938,910 | 2/1976 | Douglas | 417/12 |
| 3,949,753 | 4/1976 | Dockhorn . | |
| 3,983,857 | 10/1976 | O'Connor . | |
| 3,987,775 | 10/1976 | O'Connor . | |
| 4,020,978 | 5/1977 | Szczepanski . | |
| 4,030,640 | 6/1977 | Citrin et al. . | |
| 4,104,005 | 8/1978 | Poirier . | |
| 4,184,811 | 1/1980 | Schade . | |
| 4,257,751 | 3/1981 | Kofahl . | |
| 4,295,801 | 10/1981 | Bennett . | |
| 4,392,782 | 7/1983 | Kuehn, III et al. | 417/44.1 X |
| 4,438,654 | 3/1984 | Torstensson . | |
| 4,489,779 | 12/1984 | Dickinson et al. . | |
| 4,580,952 | 4/1986 | Eberle . | |
| 4,585,060 | 4/1986 | Bernardin et al. . | |
| 4,603,735 | 8/1986 | Black . | |
| 4,669,554 | 6/1987 | Cordy . | |
| 4,701,107 | 10/1987 | Dickinson et al. . | |
| 4,727,936 | 3/1988 | Mioduszewski et al. . | |
| 4,747,451 | 5/1988 | Adams, Jr. et al. | 417/36 X |
| 4,807,707 | 2/1989 | Handley et al. . | |
| 4,886,432 | 12/1989 | Kimberlin . | |
| 4,943,210 | 7/1990 | Bailey, Jr. et al. | 417/12 |
| 4,974,674 | 12/1990 | Wells . | |
| 4,998,585 | 3/1991 | Newcomer et al. . | |
| 5,004,405 | 4/1991 | Breslin . | |
| 5,027,902 | 7/1991 | Dickinson et al. | 166/105 X |
| 5,033,550 | 7/1991 | Johnson et al. . | |
| 5,099,920 | 3/1992 | Warburton et al. | 166/53 X |
| 5,141,404 | 8/1992 | Newcomer et al. . | |
| 5,147,184 | 9/1992 | Newcomer et al. . | |
| 5,147,185 | 9/1992 | Niehaus . | |
| 5,161,956 | 11/1992 | Fiedler . | |
| 5,316,085 | 5/1994 | Dawson | 166/53 X |

*Primary Examiner*—Frank Tsay
*Attorney, Agent, or Firm*—Harness, Dickey & Pierce, P.L.C.

[57] ABSTRACT

A counter apparatus for counting the cycling of fluid flow in an automatic pneumatic pump. A magnet inside the pump repetitively moves along a fixed path in response to the pump cycling. A magnetic sensor for detecting magnetic flux is mounted on the pump. The sensor transmits an electrical signal to a counter in response to detecting the magnet at a certain location. When the magnet leaves this location the sensor stops transmitting the signal. Since the magnet is only at any location along the path only once during a complete pump cycle, the transmitted signal represents a pump cycle which is then counted by the counter.

1 Claim, 8 Drawing Sheets

FIG 9
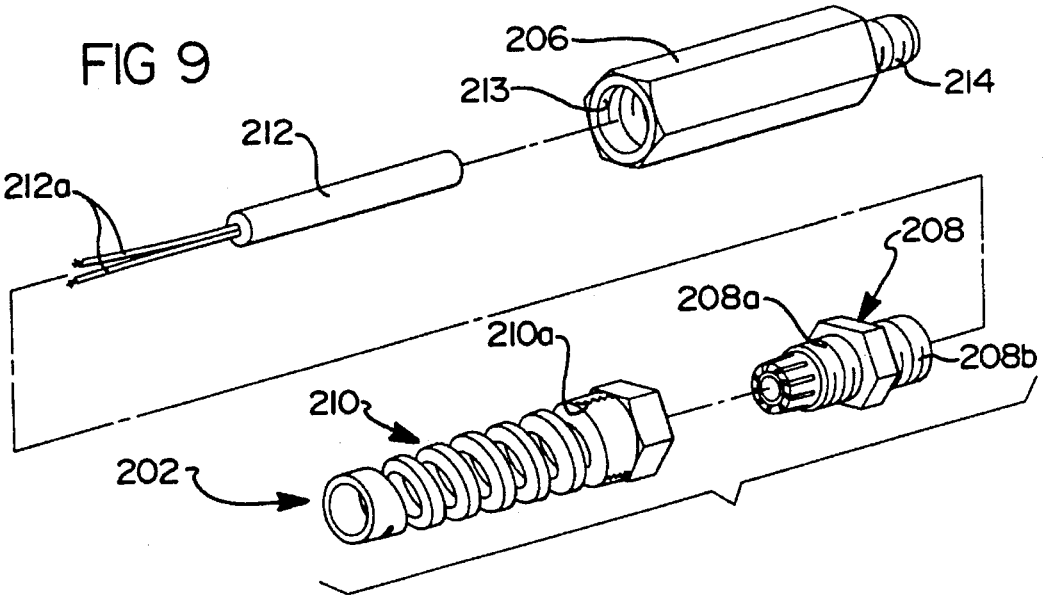
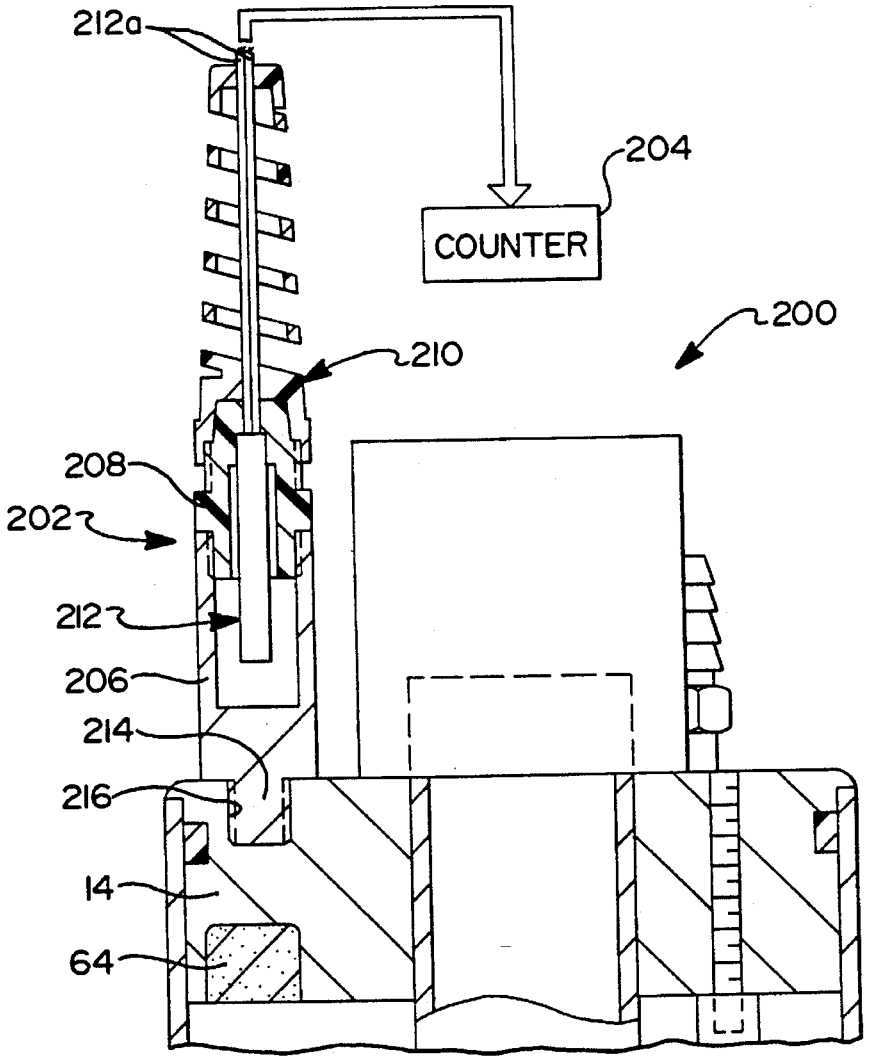
FIG 10

ELECTRONIC COUNTER WITH PUMP-MOUNTED SENSOR FOR CYCLE INDICATION

CROSS-REFERENCE TO RELATED APPLICATIONS

This application is a continuation-in-part of U.S. application Ser. No. 08/038,835, filed Mar. 29, 1993, issued Oct. 25, 1994, which is entitled "Float Operated Pneumatic Pump." which is now U.S. Pat. No. 5,358,037.

BACKGROUND OF THE INVENTION

1. Technical Field

The present invention relates to an apparatus and method for registering the cycling of an automatic pump, and more particularly to a non-invasive apparatus and method that utilizes a magnetic sensor positioned externally to a pumping system in order to count the number of cycles of operation of an automatic pump.

2. Discussion

The ability to count the number of cycles a pump has gone through is becoming increasingly important as a result of the substantial rise in the number of identified sites of contaminated ground water. Accompanying this trend has been an increased effort to clean up these sites. In response, there is a need for improved below ground pumping systems to assist in these clean up efforts.

When taking samples of groundwater for these clean up efforts, it is first necessary to purge the water in the well or monitoring site in order to get a representative sample of the groundwater. The volume of groundwater will normally be purged 3 to 5 times prior to taking a sample of the groundwater. The purging requires a relatively large number of cycles of the pump. Thus, in order to be able to effectively and consistently retrieve acceptable groundwater samples, a person must accurately know the number of cycles the pump has gone through.

Previous designs used to determine when a pump has cycled utilize sensing technology that senses the flow of air in the pump. Specifically, these designs utilize a diaphragm type sensing element in junction with either a variable orifice or a flow switch to detect the pulse of air into or out of an air displacement pump. While effective in many applications, it is still possible that the diaphragm might miss the air pulse if the variable orifice is not adjusted properly or if the pneumatic lines leading to the pump are excessively long. If transient conditions such as either air hammer, pressure spikes due to valves opening or closing, or other phenomena occur, these designs may also actuate repeatedly when no actuation should occur. Both designs affect pump performance because they place restrictions in the air supply line to the pump. Additionally, they are invasive techniques that require more maintenance, and hence are more expensive. Furthermore, these designs only detect the symptom of the pump entering the discharge phase of the pump cycle, which is the air pulse associated with the pump being in this phase.

Accordingly, what is needed is an apparatus which can sense the direct cause of the pump cycling, namely the change of position of internal parts which repeatedly move along a fixed path in response to a cycle of fluid flow.

While the present invention is being described for exemplary purposes utilized with a pumping system which is capable of self-activating in response to surrounding liquid levels, it is to be understood that the present invention can be utilized for counting cycles with any type of pump that has a part which moves in response to a cycle of fluid flow.

SUMMARY OF THE INVENTION

The present invention provides a counter apparatus in accordance with the preferred embodiments described herein for counting the cycles of fluid flow in a pump. In a preferred embodiment of the apparatus, an actuating linkage inside the pump moves from a first position to a second position in response to the fluid flow occurring during a pump cycle. A magnet is attached to or otherwise forms a part of the actuating linkage. A magnetic sensing switch is mounted on the pump. A counter is coupled to the magnetic sensing switch. When the actuating linkage moves to a predetermined position, the flux of the magnet influences the magnetic sensing switch which actuates. The magnetic sensing switch then transmits an electrical signal to the counter which registers a pump cycle.

The magnetic sensing switch transmits an electrical signal by physically forming a closed electrical circuit when subjected to a sufficiently strong magnetic force. In the preferred embodiments, the magnetic sensing switch includes a reed switch. The reed switch includes two electrical conducting magnets separated by a gap. One of the magnets is positioned firmly while the other magnet has some mobility. Each magnet is electrically connected to one end of the circuit. Upon being exposed to an external magnetic force with the proper polarization and of sufficient magnitude, the mobile magnet will be pushed toward and then touch the firmly placed magnet. At this point the magnets will form a complete circuit enabling the switch to transmit a signal to the counter.

In the present invention the magnetic sensing switch is tuned to form a closed circuit upon detecting a sufficiently strong magnetic field from the magnet. This is designed to occur when the actuation arm is at a relatively precise location during the pump cycle. Since the actuation arm travels along a fixed path, it will be at any location along this path only once during a pump cycle. Thus, each time that the magnetic sensing switch transmits a pulse will be an indication of the pump cycling. During assembly of the apparatus the reed switch is positioned "depth-wise" in a head portion of the pump such that when the actuation arm is at a desired position, the field strength of the magnet associated therewith is sufficient to actuate the reed switch. Thus, the sensitivity of the apparatus can also be adjusted during assembly to better suit the apparatus to specific applications where the sensitivity of the pump apparatus may be a critical factor in obtaining reliable counting of the number of cycles of the pump apparatus.

BRIEF DESCRIPTION OF THE DRAWINGS

The various advantages of the present invention will become apparent to one skilled in the art by reading the following specification and subjoined claims and by referencing the following drawings in which:

FIG. 9 is an exploded perspective view of a magnetic sensing switch in accordance with an alternative preferred embodiment of the present invention;

FIG. 10 is an enlarged cross-sectional view of the magnetic sensing switch of FIG. 9 mounted in a head portion of the pumping apparatus of FIGS. 1–5;

DETAILED DESCRIPTION OF THE PREFERRED EMBODIMENTS

Figure 1:
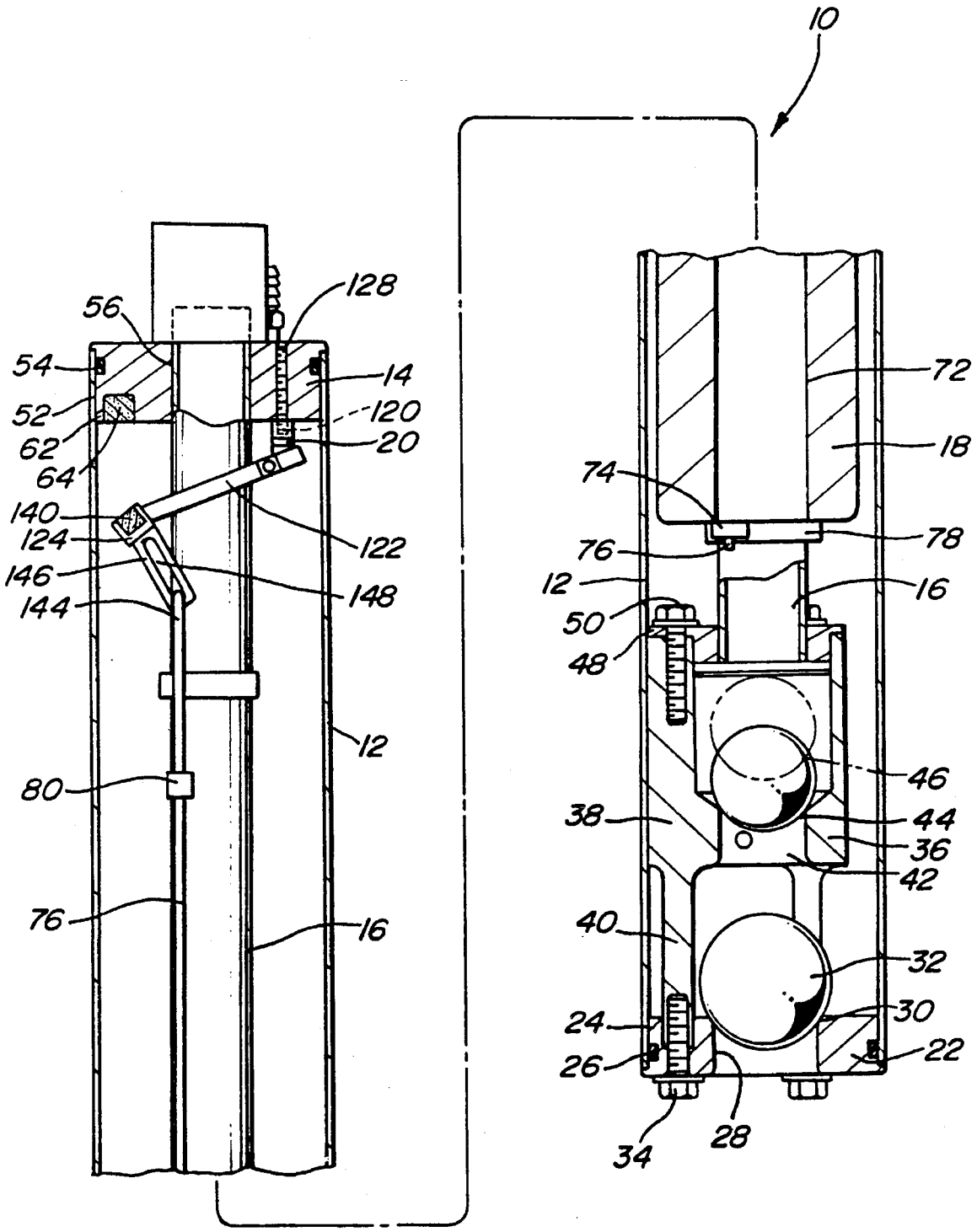
FIG. 1 is a longitudinal cross-sectional view of the pumping system in accordance with the present invention shown in the refill cycle.

Referring now to the drawings in which like reference numerals designate like or corresponding parts throughout the several views, there is shown in FIGS. 1 through 5 a pumping system 10 in accordance with the present invention. Pumping system 10 comprises a hollow pump body 12, a discharge housing 14, a dip tube 16, a float 18 and an activation mechanism 20.

Pump body 12 is a cylindrical hollow tube preferably composed of a rigid material not susceptible to corrosion, such as stainless steel. Pump body 12 is closed at its lower end by an end cap check valve 22 which is inserted into the lower end of pump body 12. End cap check valve 22 has a reduced diameter section 24 for insertion into pump body 12 and includes a seal 26 to form a liquid tight seal between end cap check valve 22 and pump body 12. End cap check valve 22 includes an inlet port 28 which extends through end cap check valve 22 and defines a valve seat 30 which mates with a check ball 32 to form a check valve which will allow fluid flow from the area around pumping system 10 (the interior of the well within which pumping system 10 is inserted) to the interior of pump body 12 but fluid flow in the opposite direction is prohibited.

Secured to the top of end cap check valve 22 by a plurality of bolts 34 is a backflow discharge check valve 36. Backflow discharge check valve 36 includes a housing 38 having a plurality of legs 40 extending from it. The plurality of legs 40 space housing 38 away from end cap check valve 22 and provide the necessary room for check ball 32 to operate. The plurality of legs 40 also operate to form a cage which encapsulates check ball 32 while still permitting fluid flow through inlet port 28 into pump body 12. Housing 38 defines an outlet port 42 which extends through housing 38 and defines a valve seat 44 which mates with a check ball 46 to form check valve 36 which will allow fluid flow from the interior of pump body 12 through dip tube 16 but fluid flow in the opposite direction is prohibited. A cap 48 is secured to the top of housing 38 by a plurality of bolts 50 and operates to retain check ball 46 within housing 38 as well as providing for the attachment of dip tube 16 as will be described later herein.

At the opposite end of pump body 12 is discharge housing 14 which has a reduced diameter portion 52 for inserting it into pump body 12. A seal 54 forms a liquid and air tight seal with pump body 12. Discharge housing 14 includes a liquid discharge port 56 which extends through discharge housing 14 and is adapted for mating with dip tube 16 as will be described later herein. Discharge housing 14 further includes an air inlet port 58, an air discharge port 60 and a bore 62 for locating a first actuating magnet 64. Air inlet port 58 is adapted to receive an air inlet valve 66 and air discharge port 60 is adapted to receive an air discharge valve 68 as will be described later herein.

Dip tube 16 extends from discharge port 56 of discharge housing 14 to cap 48 of housing 38. Dip tube 16 is sealingly 10 secured to both discharge housing 14 and cap 48 by welding or other means known well in the art. Dip tube 16 provides a path for the fluid within pump body 12 to flow out of pump body 12 through dip tube 16 and through discharge port 56. Discharge port 56 is in communication with both dip tube 16 and a discharge tube (not shown) for transporting the pumped fluid to the surface.

Float 18 is disposed within the interior of pump body 12 and defines an axial bore 72 into which dip tube 16 is inserted. There is sufficient clearance between axial bore 72 and the exterior of dip tube 16 to permit float 18 to freely move up and down along dip tube 16. Float 18 further defines a second axial bore (not shown) into which an actuating rod 76 is inserted. Actuating rod 76 is positioned parallel to dip tube 16 and there is sufficient clearance between the second axial bore in the float 18 and the exterior of actuating rod 76 to permit float 18 to freely move up and down along actuating rod 76. A lower stop 78 is fixedly secured to dip tube 16 and is positioned towards the lower end of actuating rod 76 to limit the downward movement of float 18. A second lower stop 74 is fixedly secured to actuating rod 76 and is positioned towards the lower end of actuating rod 76 in order for the weight of float 18 to be able to deactivate the pumping of the pumping system 10. An upper stop 80 is fixedly secured to actuating rod 76 and is positioned towards the upper end of actuating rod 76 to limit the upward movement of float 18. Float 18 is less dense than the liquid to be pumped and thus provides sufficient lifting action when pump 10 body 12 is filled with fluid to activate pumping system 10 as will be explained later herein. Float 18 also provides sufficient weight to deactivate the pumping of the pumping system 10 as will also be explained later herein.

Air inlet valve 66 has a generally cylindrical shaped is housing 82 defining an external surface 84 and an internal surface 86. External surface 84 is adapted to mate with air inlet port 58 within discharge housing 14. An annular groove 88 is defined by external surface 84 and receives a seal 90 for sealing the connection between discharge housing 14 and air inlet valve 66. Once adjusted to the proper location, air inlet valve 66 is fixedly secured in position by a set screw 92. Internal surface 86 defines a threaded end 94 for connection to a tube (not shown) which supplies the compressed air to the pumping system 10 for activation. The end of internal surface 86 opposite to threaded 25 end 94 forms an inlet valve seat 96. A ball 98 is positioned between threaded end 94 and valve seat 96. Ball 98 cooperates with valve seat 96 to connect and disconnect the compressed air being supplied to air inlet valve 66 with the interior of pump body 12. A retaining ring 100 is provided to maintain ball 98 within air inlet valve 66. While air inlet valve 66 has been shown and described as being a separate component secured within inlet port 58, it is within the scope of the present invention to have inlet valve 66 machined as an integral part of discharge housing 14.

Air discharge valve 68 has a generally cylindrical shaped housing 102 defining an external surface 104 and an internal surface 106. External surface 104 is adapted to mate with air discharge port 60 within discharge housing 14. An annular groove 108 is defined by external surface 104 and receives a seal 110 for sealing the connection between discharge housing 14 and air discharge valve 68. Once adjusted to the proper position, air discharge valve 68 is fixedly secured in position by set screw 112. Internal surface 106 defines a threaded end 114 for connection to a tube (not shown) which vents the interior of pump body 12 to the atmosphere. The end of internal surface 106 opposite to threaded end 114 forms an outlet valve seat 116. Outlet valve seat 116 is faced away from threaded end 114 and is adapted to mate with a spring loaded check ball 118 which is secured to activation mechanism 20. Check ball 118 cooperates with valve seat 116 to connect and disconnect the interior of pump body 12 with the outside atmosphere. While air discharge valve 68 has been shown and described as being a separate component secured within air discharge port 60, it is within the scope of the present invention to have air discharge valve 68 machined as an integral part of discharge housing 14.

Figure 2:
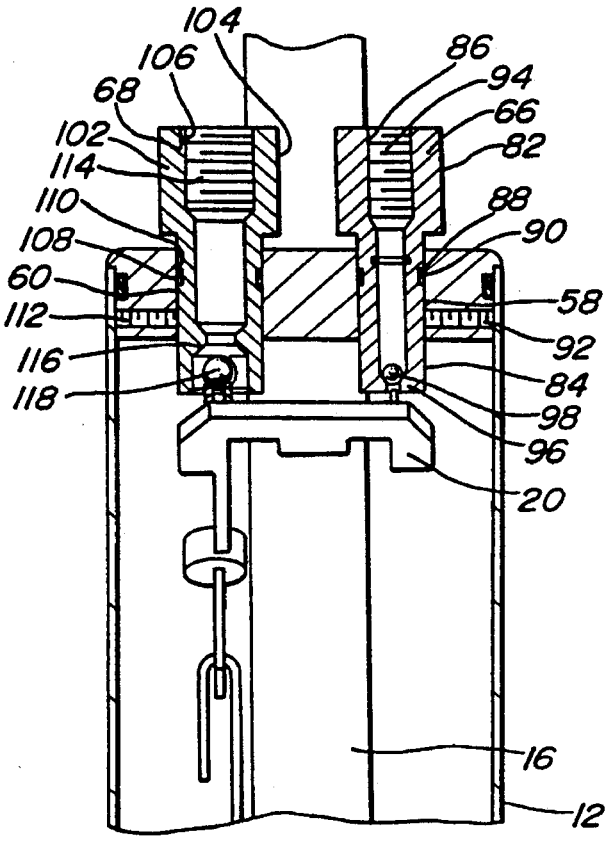
FIG. 2 is an enlarged cross-sectional view of the inlet and exhaust valves of the pumping system shown in FIG. 1 in the refill mode.
Figure 4:
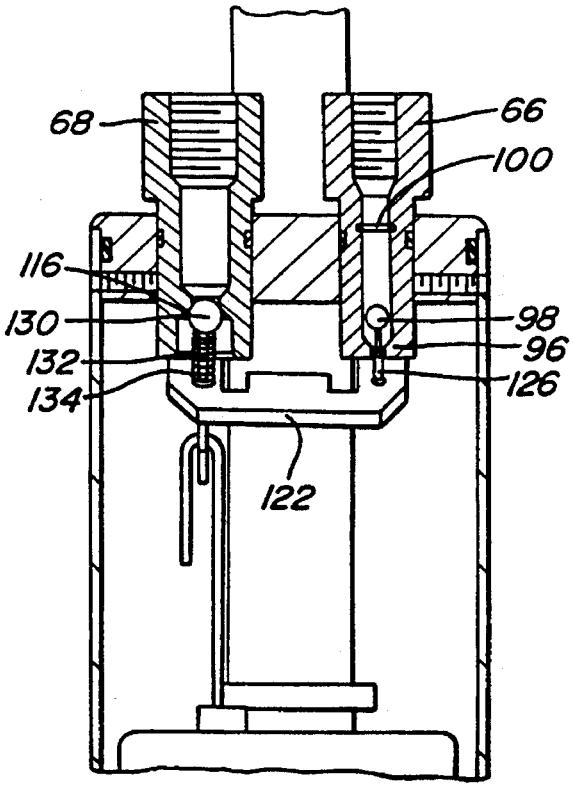
FIG. 4 is an enlarged cross-sectional view of the inlet and exhaust valves of the pumping system shown in FIG. 3 in the discharge mode.
Figure 3:
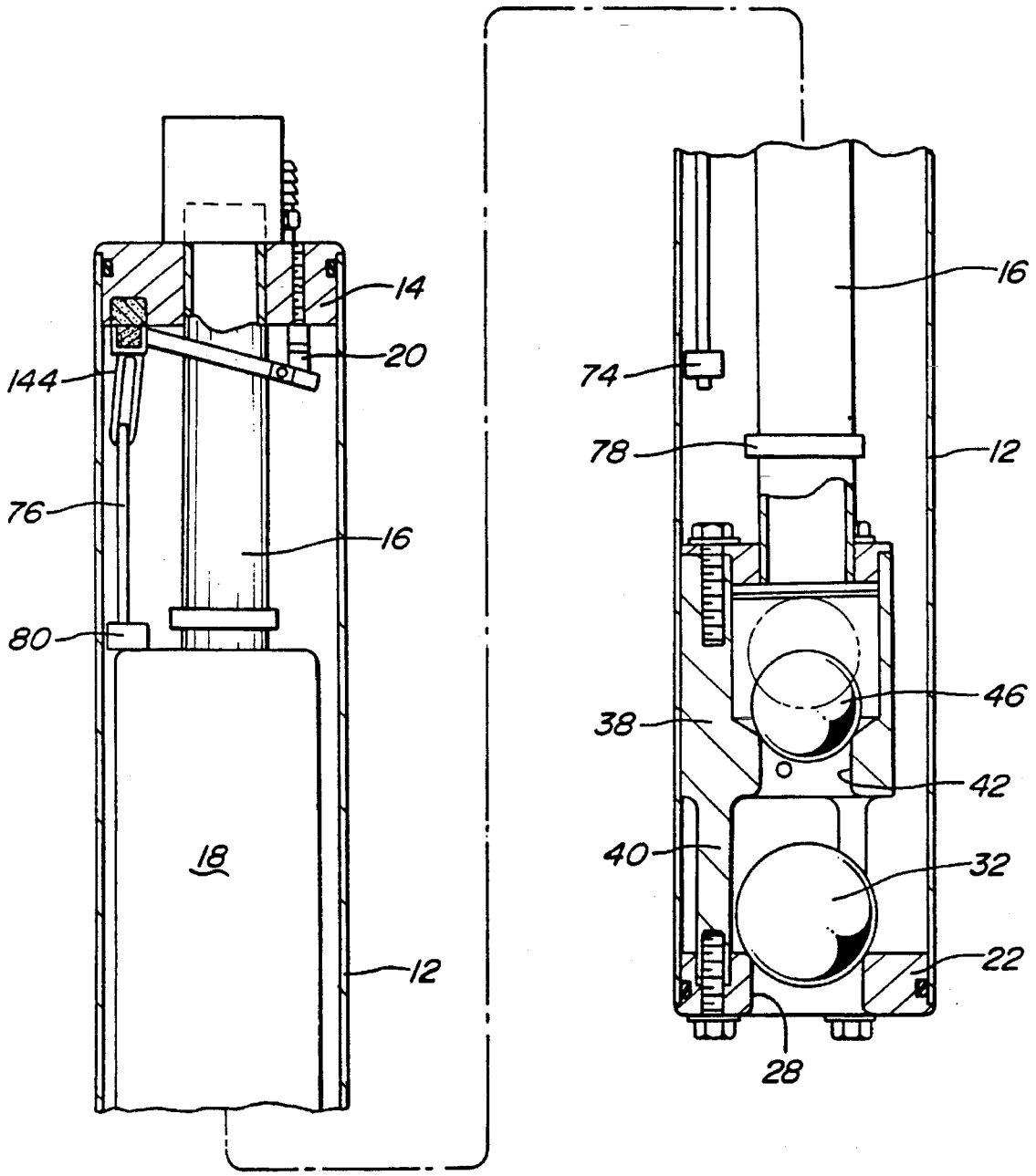
FIG. 3 is a longitudinal cross-sectional view of the pumping system in accordance with the present invention in the discharge cycle.
Figure 5:
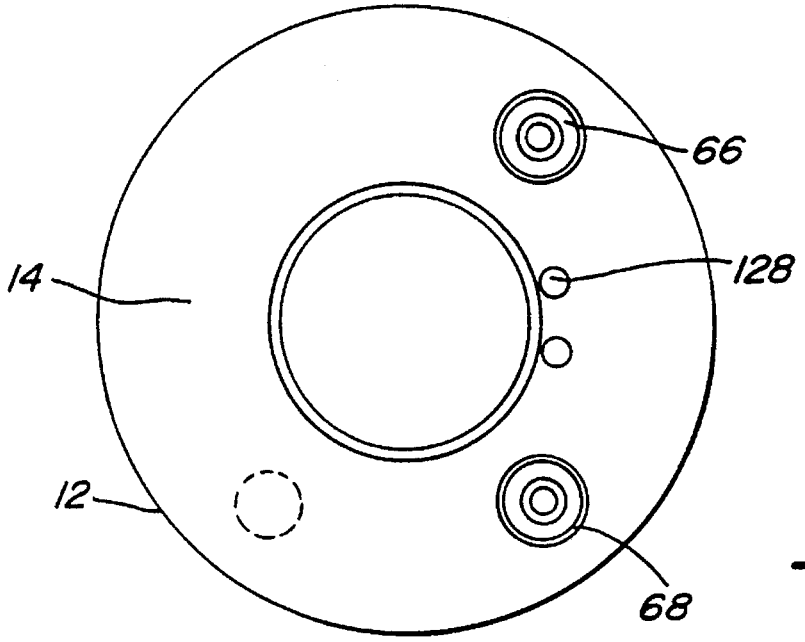
FIG. 5 is a top view of the pumping system shown in FIG. 6 showing the relative location of the connection to the pumping system.

Activation mechanism 20 comprises a bracket 120, an activation arm 122 and a magnet holder 124. Bracket 120 is fixedly secured to discharge housing 14 by a plurality of bolts 128. Pivotally attached to bracket 120 is activation arm 122. Activation arm 122 is a generally U-shaped arm which partially encircles dip tube 16. Activation arm 122 is adapted along the length of the two leg sections for mounting check ball 118 of air discharge valve 68, for mounting an activation pin 126 for activating air inlet valve 66 and for locating magnet holder 124. Activation pin 126 is mounted to one leg of activation arm 122. Activation pin 126 is mounted to one leg of activation arm 122 such that activation pin 126 contacts ball 98 and lifts ball 98 off of inlet valve seat 96 opening air inlet valve 66 when activation arm 122 is pivoted upward as shown in FIG. 4. When activation arm 122 is pivoted downward as shown in FIG. 2, ball 98 is again free to locate in inlet valve seat 96 thus closing air inlet valve 66. Check ball 118 comprises a spherical head 130 and a cylindrical stem 132. Cylindrical stem 132 is inserted through a hole in one of the legs of activation arm 122 opposite to the leg which mounts activation pin 126 and is secured to activation arm 122 by means known well in the art such that spherical head 130 is allowed to move perpendicular with respect to activation arm 122. A coil spring 134 biases spherical head 130 away from activation arm 122. Upon upward movement of activation arm 122 as shown in FIG. 4, spherical head 130 engages outlet valve seat 116 and closes air discharge valve 68. When activation arm 122 is pivoted downward as shown in FIG. 2, spherical head 130 is disengaged from outlet valve seat 116 and air discharge valve 68 is open. The spring action of check ball 118 permits closing of air discharge valve 68 before the opening of air inlet valve 66 thereby eliminating any cross over as well as taking up any wear between spherical head 130 and valve seat 116. During assembly of the pumping system 10, air inlet valve 66 and air discharge valve 68 are inserted into discharge housing 14 and adjusted such that spherical head 130 contacts outlet valve seat 116 at the same time or just prior to activation pin 126 contacting ball 98. This adjustment insures elimination of any cross over. Once adjusted, air inlet valve 66 and air discharge valve 68 are secured in place by set screws 92 and 112 respectively.

Magnet holder 124 is attached to the open end of one of the legs of activation arm 122. Magnet holder 124 receives a second actuating magnet 140. The lower end of magnet holder 124, or the end opposite to magnet 140, is attached to an actuator linkage or lost motion device 144. Magnet 140 is adapted to mate with magnet 64 to keep activation arm 122 in an upward position thus maintaining the discharge mode of the pumping system 10 until the weight of float 18 acts to separate the two magnets and switch the pumping system 10 into the refill mode. Actuator linkage 144 makes the connection between magnet holder 124 of activation mechanism 20 and float 18. Actuator linkage 144 comprises a bracket 146 which is fixedly attached to the lower end of magnet holder 124 and has a longitudinally extending slot 148. Actuating rod 76 has a U-shaped bend in the upper end thereof such that actuating rod 76 extends through slot 148 of bracket 146. Linkage 144 allows relative movement between actuating rod 76 and activation mechanism 20 to allow for the movement of activation arm 122 due to the mutual attraction of magnets 64 and 140 as will be described later herein.

The operation of the pumping system 10 begins with the insertion of the pumping system 10 within a well (not shown). Appropriate connecting tubes (not shown) attach air inlet valve 66 to a source of compressed air, air discharge valve 68 to the outside atmosphere and discharge housing 14 to a discharge line. Upon insertion into the well, the pumping system 10 is in the refill mode as shown in FIGS. 1 and 2. Fluid from the well enters the interior of pump body 12 through end cap check valve 22. This refill mode continues due to the hydrostatic effect of the fluid within the well and continues to fill pump body 12 which causes float 18 to begin to rise.

Float 18 continues to rise until contact is made with upper stop 80 on actuating rod 76. This contact with the upper stop 80 begins to move actuating rod 76 upward until stop 80 contacts bracket 146. Continued upward movement of float 18 will then begin to pivot actuation arm 122. As activation arm 122 continues to pivot, spherical head 130 of check ball 118 of air discharge exhaust valve 68 will come into contact with outlet valve seat 116 closing air discharge valve 68. At the same time or shortly after spherical head 130 contacts outlet valve seat 116, activation pin 126 of activation mechanism 20 contacts ball 98 lifting ball 98 off of inlet valve seat 96 and providing compressed air into the interior of pump body 12. The spring mounting of spherical head 130 and the cylindrical stem 132 permit continued pivotal movement of activation arm 122 after spherical head 130 contacts outlet valve seat 116. In addition, the lever arm form of activation arm 122 significantly increases the load exerted by the buoyancy of float is thus insuring the sealing of air discharge valve 68. Once activation arm 122 reaches this position, magnet 140 and magnet 64 are mutually attracted causing a magnetic locking which holds activation arm 122 in the upward position. Magnets 140 and 64 are allowed to snap together due to the movement of bracket 146 with respect to actuating rod 76 as actuating rod 76 moves within slot 148.

When activation pin 126 lifts ball 98 off of inlet valve seat 96 and compressed air enters the interior of pump body 12, fluid within pump body 12 is forced up through outlet port 42, through dip tube 16, through discharge port 56 and through the associated discharge line. Fluid is not allowed to exit pump body 12 other than through outlet port 42 due to the operation of air discharge valve 68 and end cap check valve 22. Fluid continues to leave pump body 12 and eventually float 18 begins to lower. As float 18 begins to move downward, air inlet valve 66 is held open and air discharge valve 68 is held closed by the magnetic attraction of magnets 140 and 64 holding activation arm 122 in an upward position. As float 18 continues to lower, float 18 will contact lower stop 74 and thus begin to exert a load on the attached magnets 140 and 64 due to the weight of float 18 reacting through actuating rod 76. When the level of fluid within pump 12 lowers to the point that the weight of float 18 supported by actuating rod 76 exceeds the load necessary to separate magnets 140 and 64, activation arm 122 pivots downward and closes air inlet valve 66 and opens air discharge valve 68. Downward movement of float 18 is limited by lower step 78 on dip tube 16. Pumping system 10 will then begin another cycle. This pump cycling will continue as long as compressed air is provided to air inlet valve 66 and fluid is present in the well surrounding pumping system 10.

Figure 6:
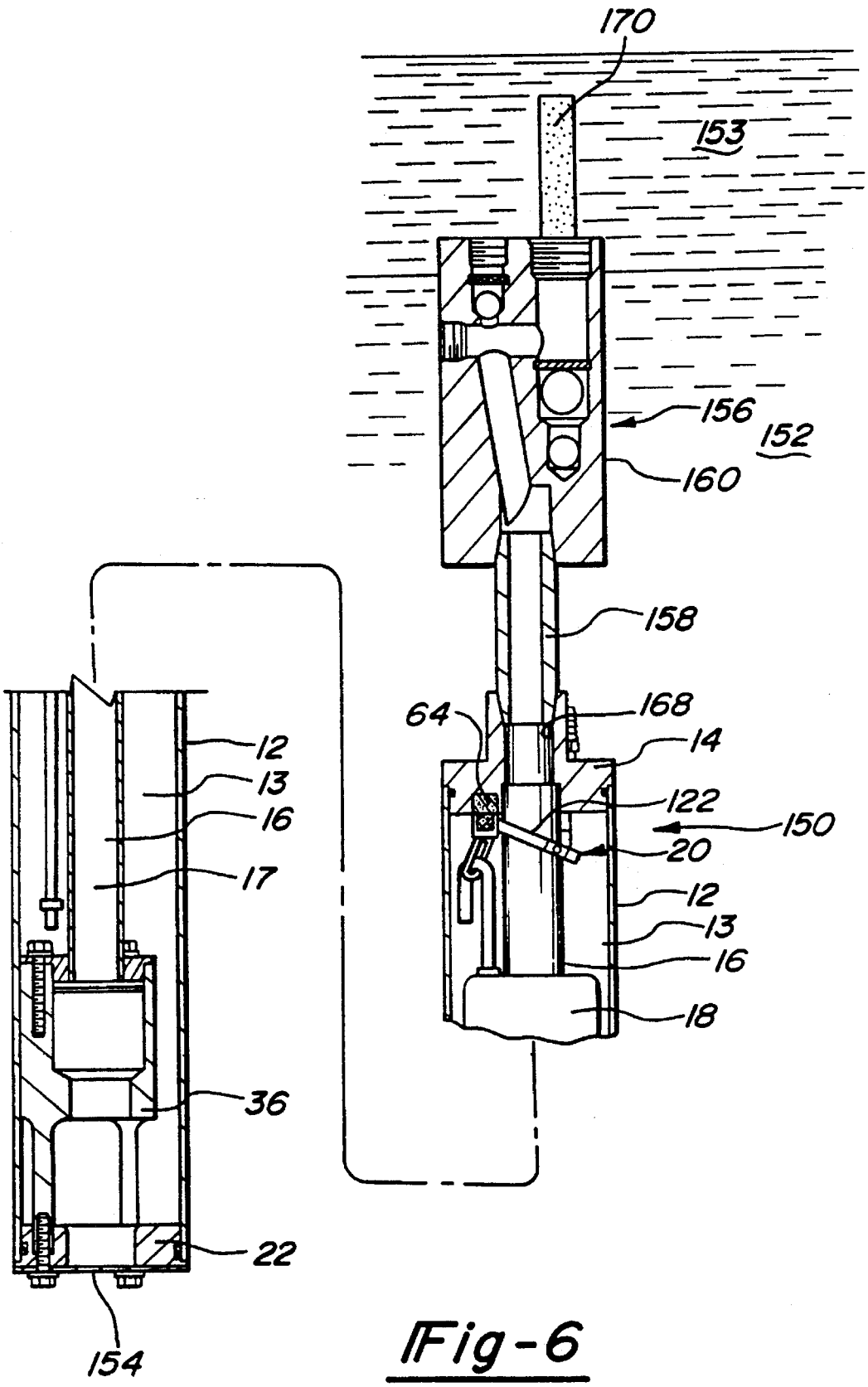
FIG. 6 is a longitudinal cross-sectional view of another pumping system according to the present invention.
Figure 7:
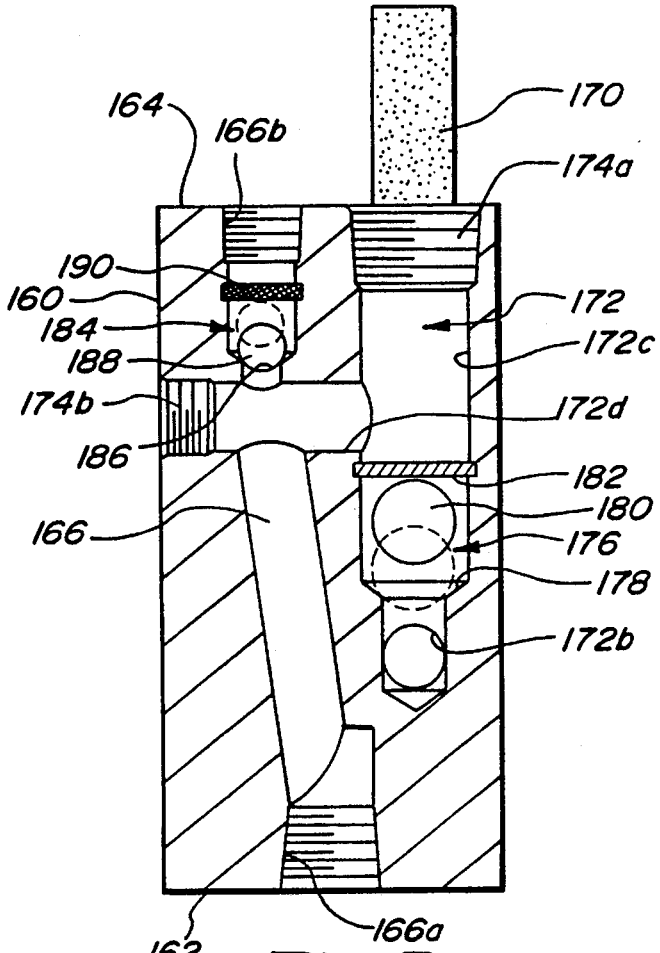
FIG. 7 is an enlarged view of a discharge check valve assembly shown in FIG. 6.
Figure 8:
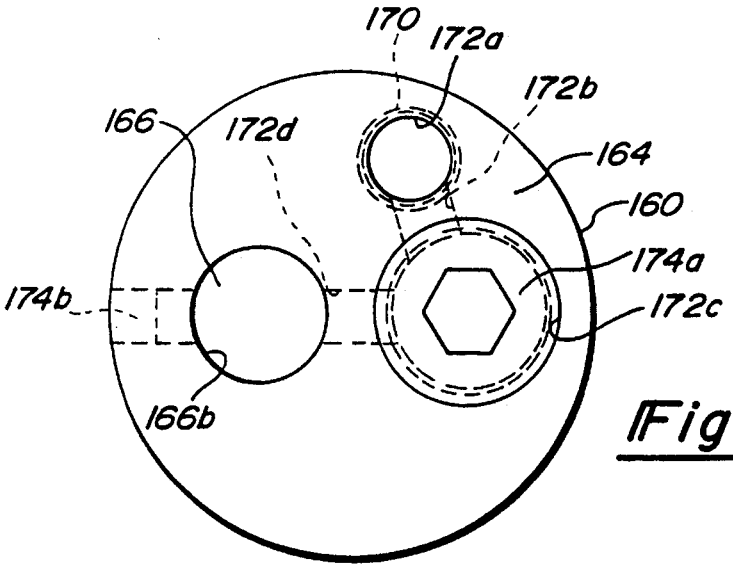
FIG. 8 is a top plan view of the discharge check valve assembly shown in FIG. 6.

A preferred embodiment of a top fill recovery unit or pumping system 150 according to this invention is shown in FIGS. 6–8. The pumping system 150 is particularly adapted or immersion into groundwater 152 below the ground and skimming a thin layer 153 of hydrocarbon, such as oil or gasoline, which are lighter than water and reside on the top of the groundwater. Because the pumping system 150 is similar to the bottom entry pumping system 10, like reference numerals will be used for like parts.

The pumping system 150 includes the pump body 12, the discharge housing 14, the dip tube 16, the float 18, and the activation mechanism 20 and 122. The discharge housing 14 is secured to the upper end of the pump body 12 and mounts the air inlet valve 66, the air discharge valve 68, and the upper end of the dip tube 16. The pump body 12 and the dip, tube 16 are generally concentrically arranged whereby to form outer and inner chambers 13 and 17. Additionally, the actuation arrangement, including the activation arm 122 connected to the valves 66 and 68, the magnets 64 and 140, and the actuation rod connecting the arm with the float, is provided in the manner as discussed before.

According to this embodiment of the invention, the pump body 12 is closed at its lower end by a closure plate 154 to prevent entry of external groundwater into the chambers 13 and 17. As shown, the closure plate 154 blocks entry of external groundwater adjacent to the lower end of the pump body 12 into the area formed below the lower entrance to the dip tube 16. In the arrangement shown, and as well be described hereinafter, the check balls 32 and 46 are removed from the end cap check valve 22 and back flow check valve 36. That is, the inlet check valves 22 and 36 are not needed as such, only that a passage be provided whereby communication between the chambers 13 and 17 is provided.

According to this invention, a discharge check valve assembly 156 for transporting the hydrocarbons from the pump body via the discharge line (not shown) to a holding tank at a remote location is connected to the discharge housing 14 by a discharge conduit 158. The discharge check valve assembly 156 comprises a valve body 160 having a lower end face 162, an upper end face 164, and a discharge bore 166 extending between the end faces. The discharge bore 166 defines a threaded inlet 166a that opens onto the lower end face 162 and is connected to the upper end portion of the discharge conduit 158 and a threaded outlet 166 that opens onto the upper end face 164 and is connected to the discharge line. In this arrangement, the discharge line is disconnected from the outlet bore 168 of the discharge housing 14 and reconnected to the outlet **166*b* of the discharge valve assembly, and the lower end portion of the conduit is threadably connected to the outlet bore 168 in the housing 14**.

An arrangement for drawing the hydrocarbons from the groundwater 152 includes a semi-permeable screen 170 which is positioned in the hydrocarbon layer 153, and an elongated passage 172, the passage extending from the screen, into the valve body 160, and into communication with the discharge bore 166. As shown, the passage 172 includes, in sequence, a first passage portion **172*a* that extends from the upper end face 164 and passes 172*b*, hydrocarbons received by the screen 170, a second passage portion 172*b*, a third passage portion 172*c*, and a fourth passage portion 172*d*, that communicates with the discharge bore 166**.

The screen 170 can, depending on the application, comprise a hydrophobic screen and pass only hydrocarbon (i.e., block groundwater), or a standard thin mesh membrane. Each are conventional and commercially available.

The third and fourth passage portions **172*c* and 172*d*, are conveniently formed by drilling a respective bore into the valve body 160 and closing the bores by plugs 174*a* and 174*b*. The third passage portion 172*c* defines, in part, a check valve 176 including a check valve seat 178 and a check ball 180 which will lift from the valve seat to allow fluid received from the screen to pass, but prohibit fluid to flow back to the screen 170. The check ball 180 must lift freely but is subject to material sticking to its surfaces, possibly inhibiting smooth opening of the valve. Preferably, the check ball 180 is comprised of Teflon or other suitable material that will inhibit substances from sticking to its surface. A previous wire retainer 182 is secured is in the passage to limit movement of the check ball 180** from its unseated position but permit fluid to pass.

The discharge bore 166 includes, in part, a check valve 184 including a check valve seat 186 and a Teflon check ball 188, the check valve allowing fluid received from the fourth passage portion **172*d*, to be discharged from the valve body 160 via the outlet 166*b*. A previous wire retainer 190 is secured in the passage to limit movement of the check ball 188** from its unseated position but permit fluid to pass.

In operation, the pumping system 150 is positioned in the 2S groundwater with its screen 170 protruding into the hydrocarbon to be skimmed. Initially, the air inlet valve 66 is closed and the air discharge valve is open to atmosphere. Fluid from the hydrocarbon layer enters the valve body 160 through the screen 170, passes through the passage portions **172*a*, 172*b*, and 172*c*, causing the check ball 180 to rise, through the retainer screen 182 and downwardly through the discharge bore, through the inlet 166*a* and the discharge conduit 158, and into the pump body 12. This filling operation continues, causing the chamber 13 to fill and the float 18** to rise.

Thereafter, as described above, the float 18 will engage and cause the activation arm 122 to pivot, the check ball 118 will close the discharge valve 68, and the check ball 98 will lift from its valve seat 96 whereby to admit compressed air into the chamber 13 of the pump body 12. The hydrocarbon fluid in the pump body 12 is forced downwardly in chamber 13, into the chamber 17, up through the dip tube 16, through the discharge conduit 158, through the discharge bore 166, and through the discharge outlet **166*b*. The hydrocarbon fluid is expelled from the body 12, causing the chamber 13 to empty, the float 18 to be lowered resulting in the activation arm 122 pivoting downwardly, the air inlet valve 66 being closed, and the air discharge valve 68** being opened.

The pumping system 150 will then begin another cycle, the pump cycling continuing as long as compressed air is provided to air inlet valve 66 and fluid is present in the well surrounding the pumping system.

The top fill recovery unit 150 is easily modified to the bottom fill underground contaminated water recovery unit, such as shown by the pumping system 10, by removing the closure plate 154, replacing the check balls 32 and 46 in the inlet check valves 22 and 38 arranged at the lower end portion, removing the top discharge check valve assembly 156, and connecting the return line directly to the top of the assembly. As such, the user can purchase a set, comprising the basic tubular housing, and each of the specific elements needed to assemble the top fill and the bottom fill units.

Referring now to FIGS. 9 through 12, a pumping apparatus 200 in accordance with an alternative preferred embodiment of the present invention is shown. Pumping apparatus 200 generally includes a magnetic sensing switch 202 and a counter 204. With the exception of magnetic sensing switch 202 and counter 204, pumping apparatus 200 is identical to the pumping system 10 of FIGS. 1 through 5. Thus, the same reference numerals will be used for the components of pumping apparatus 200 which correspond to the same components as described in connection with FIGS. 1 through 5.

As shown in FIG. 9, magnetic sensing switch 202 includes a housing 206, a fitting 208, a strain relief member 210, and a reed switch 212. It will be appreciated, however, that the strain relief member 210 is optional, but helps to relieve the strain that might be experienced by the reed switch 212 during assembly or use. Reed switch 212 is a conventional reed switch well-known in the art. Reed switch 212 is placed inside the housing 206. The housing 206 is then sealed by the fitting 208. The strain relief member 210 has an internal threaded portion 210*a* which is threadably tightened around a threaded end portion 208*a* of the fitting 208 after being slid over the electrical wires 212*a* of reed switch 212 to provide a strain relief for the wires. Housing 206 is fabricated to include a threaded blind hole 213 and a threaded male portion 214. The threaded blind hole 213 threadably accepts a threaded portion 208*b* of the fitting 208.

As shown in FIG. 10, a threaded blind hole 216 is formed in the discharge housing 14. The magnetic sensing switch 202 is secured to an exterior surface 14*a* of the discharge housing 14 when the threaded male portion 214 is screwed into the blind hole 216. The magnetic sensing switch 202 is positioned approximately over the stationary first actuating magnet 64 and separated by discharge housing 14. Magnetic sensing switch 202 is electrically connected to a conventional electronic counter 204 adapted to respond to pulse-like signals.

Magnetic sensing switch 202 is positioned "depth-wise" in the housing 14 so as to not actuate under the sole influence of the magnetic field of the first actuating magnet 64. The distance between the read switch 212 and the first actuating magnet is preferably about 0.5"–1.0", and more preferably about 0.75". Magnetic sensing switch 202 only switches on and transmits an electric pulse to the counter 204 through the electrical wires 212*a* of the reed switch 212 when it detects a sufficient amount of magnetic flux.

Figure 11:
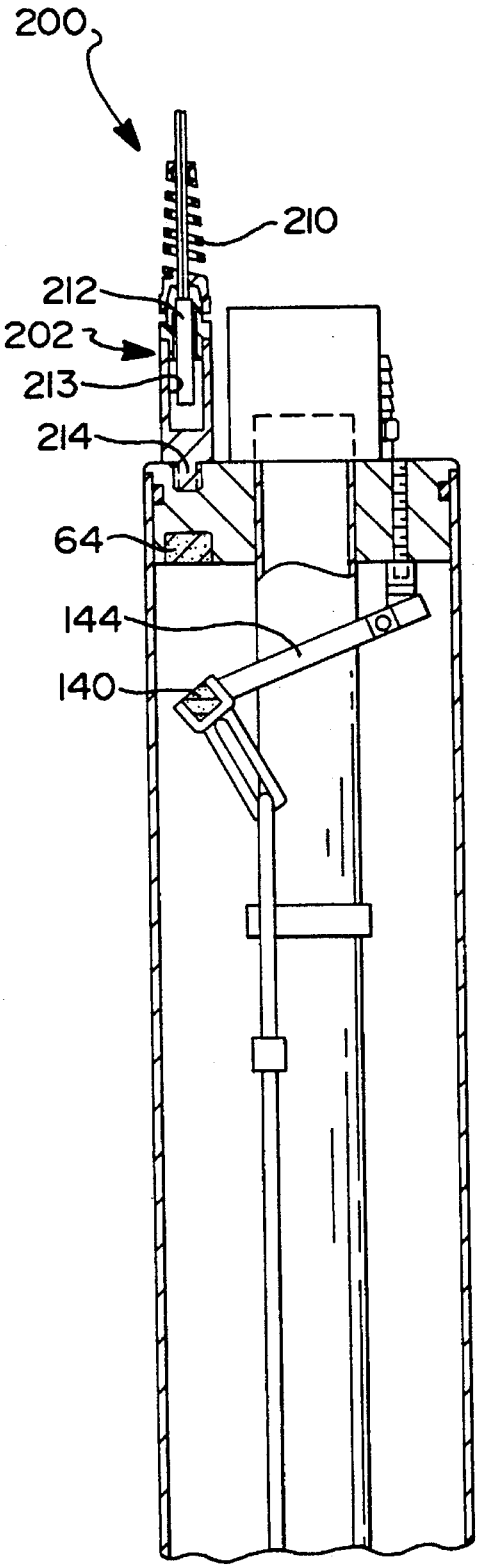
FIG. 11 is a fragmentary, cross-sectional view of the pumping apparatus of FIG. 10 shown in the refill cycle.
Figure 12:
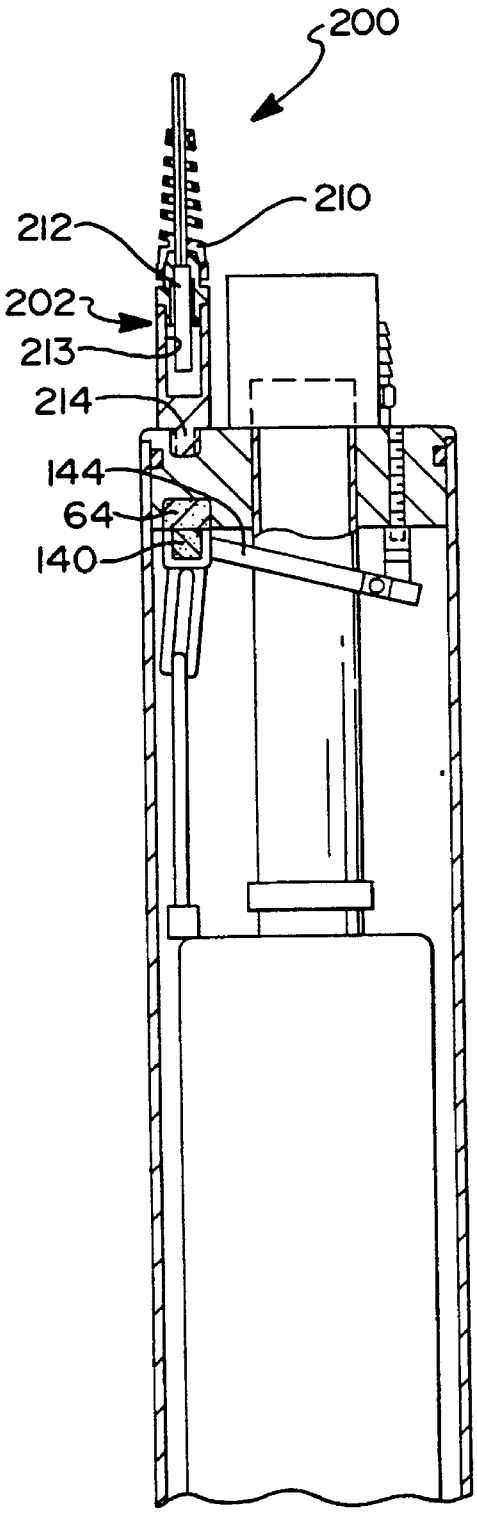
FIG. 12 is a view of the pumping apparatus of FIG. 10 shown in the discharge cycle.

Referring now to FIGS. 11 and 12, magnetic sensing switch 202 will be subjected to more magnetic flux when it is influenced by the second actuating magnet 140 in addition to the first actuating magnet 64. The maximum amount of flux that magnetic sensing switch 202 senses occurs when the second actuating magnet 140 contacts the first actuating magnet 64. Just prior to this condition occurring (which occurs when pumping apparatus 200 is in the discharge mode of the pump cycle), the magnetic sensing switch 202 is positioned such that the combined magnetic flux of the magnet 140 and the magnet 64 is sufficient to actuate the sensing switch 204 to cause the switch 204 to close. This causes an electrical signal to be generated which is transmitted to the counter 204 which registers a cycle. When the discharge is completed the two magnets separate due to the weight of the descending float and switch the pumping apparatus 200 into the refill mode of the pump cycle. When the magnets 64 and 140 separate, the magnetic sensing switch 202 will detect a lesser amount of magnetic flux and will switch to an open electrical circuit. Since the second attracting magnet 140 is attached to actuator linkage 144, which repetitively moves along a fixed path during the fill and discharge phases of the pump cycle, the maximum amount of magnetic flux generated which magnetic sensing switch 202 is positioned to detect reliably indicates the number of times the pump apparatus 200 cycles.

The magnetic sensing switch 202 thus forms a reliable means for providing a signal indicative of the number of cycles that the pumping apparatus 200 experiences without the disadvantages of prior developed systems for counting pump cycles. The sensing switch 202 is further relatively inexpensive and thus does not add appreciably to the overall cost of the pumping apparatus 200. The sensing switch 202 provides the further advantage of being easily retrofitted to previously manufactured pumping apparatuses with a minimum degree of modification to the pumping apparatus, and does not add to the cross-sectional size of the pumping apparatus.

It will also be appreciated that the sensing switch 202 of the present invention will work with virtually any apparatus where it is desirable to count the number of cycles of the apparatus or the number of times which it is turned on, providing the apparatus has at least one moving element to which a magnetic member may be secured or otherwise formed with.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. A counter apparatus for counting cycles of a fluid flow in a pump having a housing including an exterior surface, said apparatus comprising:

an actuating mechanism disposed in said pump, said actuating mechanism movable from a first position to a second position in response to said fluid flow;

a first attracting magnet attached to said actuating mechanism;

a magnetic sensing switch comprising a reed switch mounted on an exterior surface of said housing of said pump;

a counter coupled to said magnetic sensing switch;

said magnetic sensing switch being actuated in response to a magnetic field of said first attracting magnet when said actuating mechanism moves from said first position to said second position, said magnetic sensing switch transmitting an electrical signal to said counter in response to being actuated by said first attracting magnet, said counter counting a cycle of said fluid flow in response to said electrical signal; and a stationary second attracting magnet disposed within said pump, said second attracting magnet positioned to be able to magnetically attach to said first magnet when said actuating mechanism moves toward said second position.

* * * * *